United States Patent [19]

Reinhold et al.

[11] Patent Number: 4,989,420

[45] Date of Patent: Feb. 5, 1991

[54] RING WITH HIDDEN INTERNAL COMPARTMENTS

[75] Inventors: John B. Reinhold; Marc Jacobs, both of New York, N.Y.

[73] Assignee: Reinhold-Caribe, Inc., New York, N.Y.

[21] Appl. No.: 547,492

[22] Filed: Jul. 3, 1990

[51] Int. Cl.[5] ..... A44C 9/00

[52] U.S. Cl. ..... 63/15; 63/1.1; 221/76; 221/83; 221/185

[58] Field of Search ..... 63/1.1, 2, 3, 15, 15.1, 63/15.2, 15.3, 15.4, 15.8; 224/217, 219, 229; 206/315, 9, 526; 221/76, 82, 83, 89, 154, 185

[56] References Cited

U.S. PATENT DOCUMENTS

| | | | |
|---|---|---|---|
| 581,549 | 4/1897 | Goetz . | |
| 1,236,163 | 8/1917 | Hackett et al. | 221/82 X |
| 1,586,606 | 6/1926 | Cain | 63/15.4 X |
| 1,814,467 | 7/1931 | Cedar | 63/15 |
| 1,830,929 | 11/1931 | Cohen . | |
| 1,832,161 | 11/1931 | Weaver | 63/1.1 X |
| 2,048,878 | 7/1936 | Moldenhauer . | |
| 2,357,697 | 9/1944 | Slater . | |
| 2,453,955 | 11/1948 | Younghusband | 63/15 |
| 2,668,369 | 2/1954 | Hepp . | |
| 3,022,648 | 2/1962 | Thaler | 63/15 |
| 3,559,854 | 2/1971 | Loveland | 63/1.1 X |
| 4,427,130 | 1/1984 | Szigeti . | |
| 4,572,403 | 2/1986 | Benaroya | 221/76 X |

*Primary Examiner*—James R. Brittain

*Attorney, Agent, or Firm*—Amster, Rothstein & Ebenstein

[57] ABSTRACT

A ring with a plurality of hidden internal compartments for receiving articles includes an inner circular member and an outer circular member. The outer member defines a plurality of laterally separated, inwardly open compartments for receiving articles and an inwardly biased tab at least partially disposed in a predetermined one of the compartments. The inner circular member is concentrically mounted on the outer member for rotation relative thereto and defines a single aperture therethrough. The aperture is configured and dimensioned to at least partially receive the tab or to act as a passageway for articles into and out of a radially aligned one of the compartments, depending upon the relative rotational orientation of the inner and outer members.

12 Claims, 3 Drawing Sheets

RING WITH HIDDEN INTERNAL COMPARTMENTS

BACKGROUND OF THE INVENTION

The present invention relates to a ring and, more particularly, to a ring having a plurality of hidden internal compartments for concealing small articles.

U.S. Pat. Nos. 2,357,697 and 4,427,130 disclose rings having compartments which are at all times accessible from the outer surface of the ring. Such rings are not suitable for the secret storage of valuables, such as small diamonds or other small articles, first, because an inspection of the ring easily reveals the presence of the hidden compartment, and, second, the hidden compartment can easily be opened even while the ring is being worn. U.S. Pat. Nos. 2,048,878 and 1,830,929 disclose rings formed of concentric members which ar pivotally mounted together and have one of the members tiltable relative to the other. The purpose of the rings is to protect from wear engraving or like writing on the outer surface of the inner member or the inner surface of the outer member, with the engraving or like writing being capable of exhibition on special occasions. These rings do not, however, provide a compartment in which valuables can be concealed. Thus the need remains for a ring which can concealed small articles within its hidden internal compartments with a high degree of security.

Accordingly, it is an object of the present invention to provide a ring having a plurality of hidden internal compartments for concealing small articles.

Another object is to provide such a ring in which the compartments cannot be accessed while the ring is being worn.

A further object is to provide such a ring which has the appearance of a normal ring, such as a wedding band.

It is also an object to provide such a ring formed of two concentric members, relative rotation of the two members in one direction enabling access to the compartments, and relative rotation of the members in the other direction being blocked.

It is another object of the present invention to provide such a ring which is of rugged and economical construction.

SUMMARY OF THE INVENTION

It has now been found that the above and related objects of the present invention are obtained in a ring having a plurality of hidden internal compartments for receiving articles. The ring comprises outer and inner circular members. The outer circular member defines a plurality of laterally separated, inwardly open compartments for receiving articles and an inwardly biased tab at least partially disposed in a predetermined one of the compartments. The inner circular member is concentrically mounted on the outer member for rotation relative thereto and defines a single aperture therethrough. The aperture is configured and dimensioned to at least partially receive the tab or to act as a passageway for articles into and out of a radially aligned one of the compartments, depending upon the relative rotational orientation of the inner and outer members.

In a preferred embodiment the inner and outer members are coaxially mounted for relative rotation within a given plane and together have the appearance of a normal ring without any hidden internal compartment, such as a wedding band. The outer circular member defines at least three of the compartments, and the relative rotational orientation of the inner and outer members determines the one of the compartments to be radially aligned with the aperture. The compartments are accessible only through the aperture. The aperture is coextensive with the inwardly open wall of the aligned one compartment and acts as a radial passageway into and out of the aligned one compartment.

The tab has one end portion thereof secured in the predetermined one compartment and the other end portion thereof movable between a first position wherein the other end is disposed in the predetermined one compartment of the outer member and a second position wherein the other end extends into the aperture of the inner member. The other end of the tab permits relative rotation of the inner and outer members in one direction while blocking relative rotation of the inner and outer members in the opposite direction. The other end of the tab is biased for movement from the first position into the second position, the other end in the second position being displaceable into the first position by relative rotational orientation of the inner and outer members.

The compartments for concealing articles are not accessible when the ring is being worn.

BRIEF DESCRIPTION OF THE DRAWING

The above brief description as well as further objects and features of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
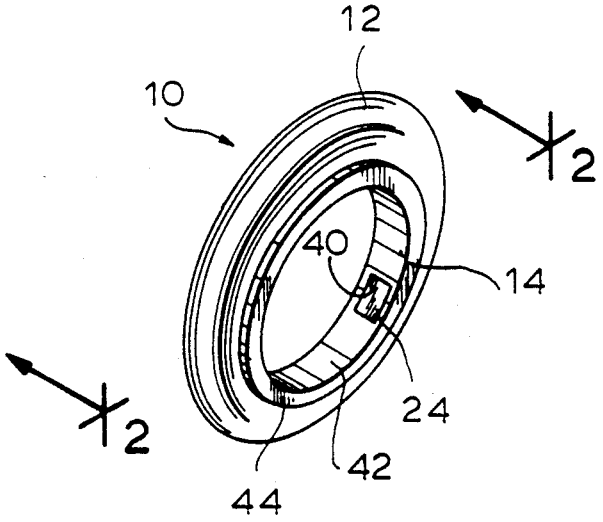
FIG. 1 is an isometric view of a ring according to the present invention.
Figure 2:
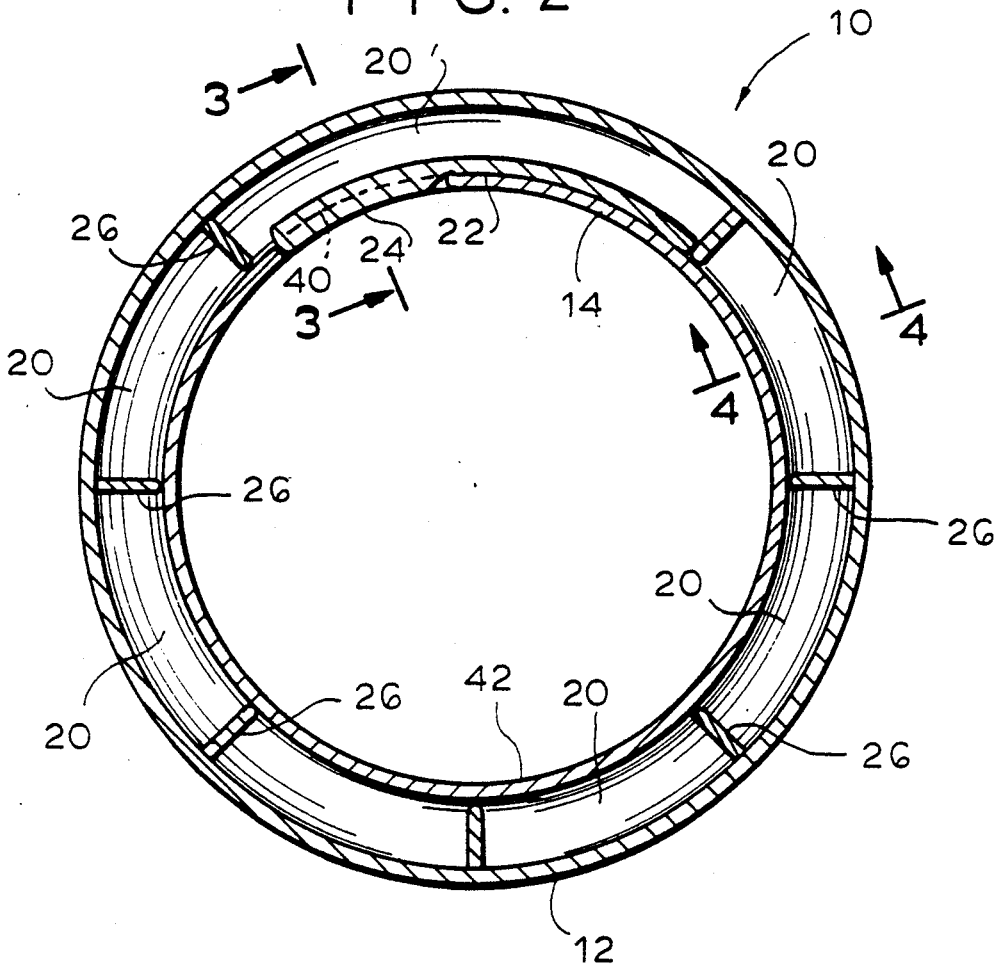
FIG. 2 is a sectional view thereof, taken along the line 2—2 of FIG. 1.
Figure 4:
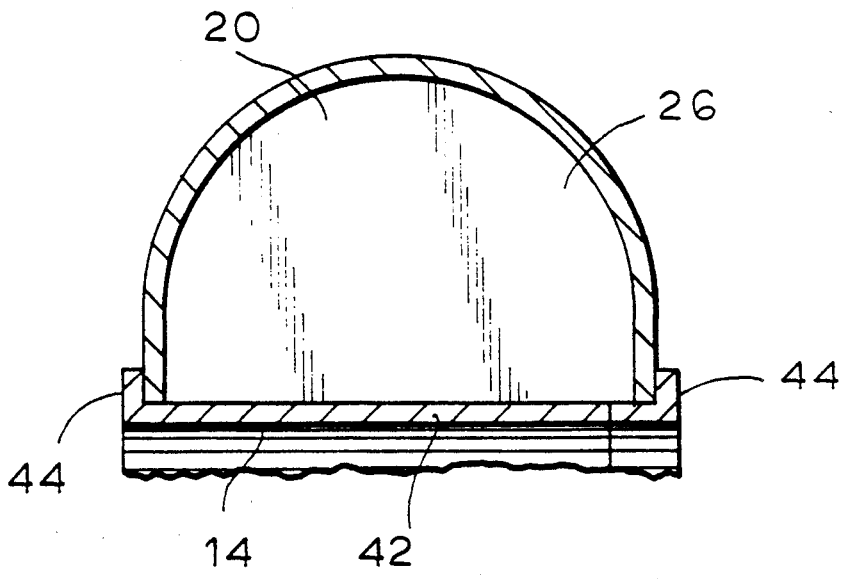
FIG. 4 is a sectional view thereof, taken along the line 4—4 of FIG. 2.
Figure 3:
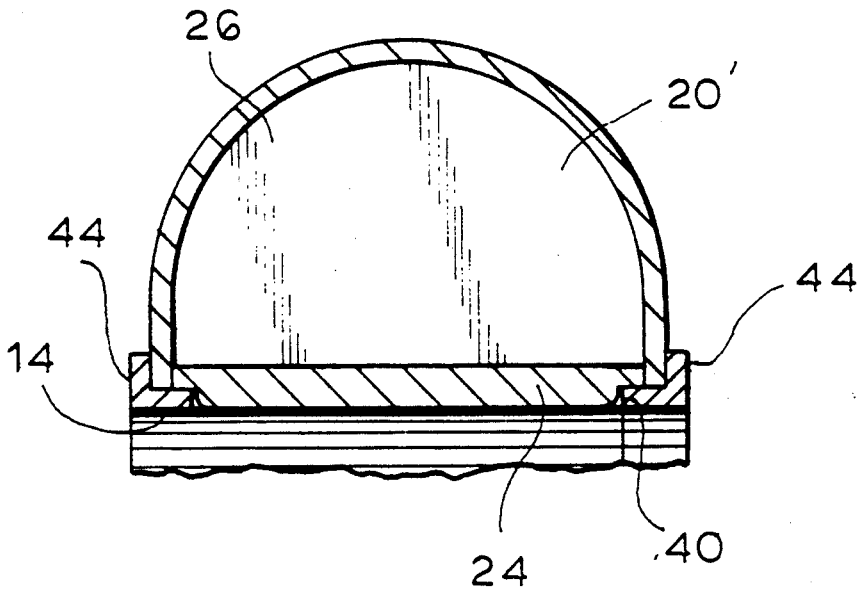
FIG. 3 is a sectional view thereof, taken along the line 3—3 of FIG. 2.
Figure 6:
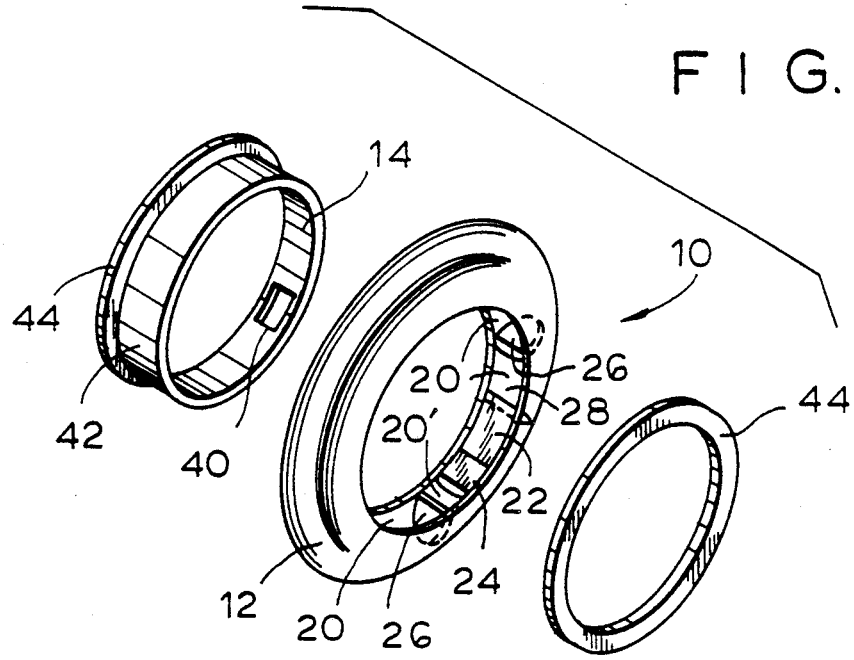
FIG. 6 is an exploded isometric view thereof.
Figure 5:
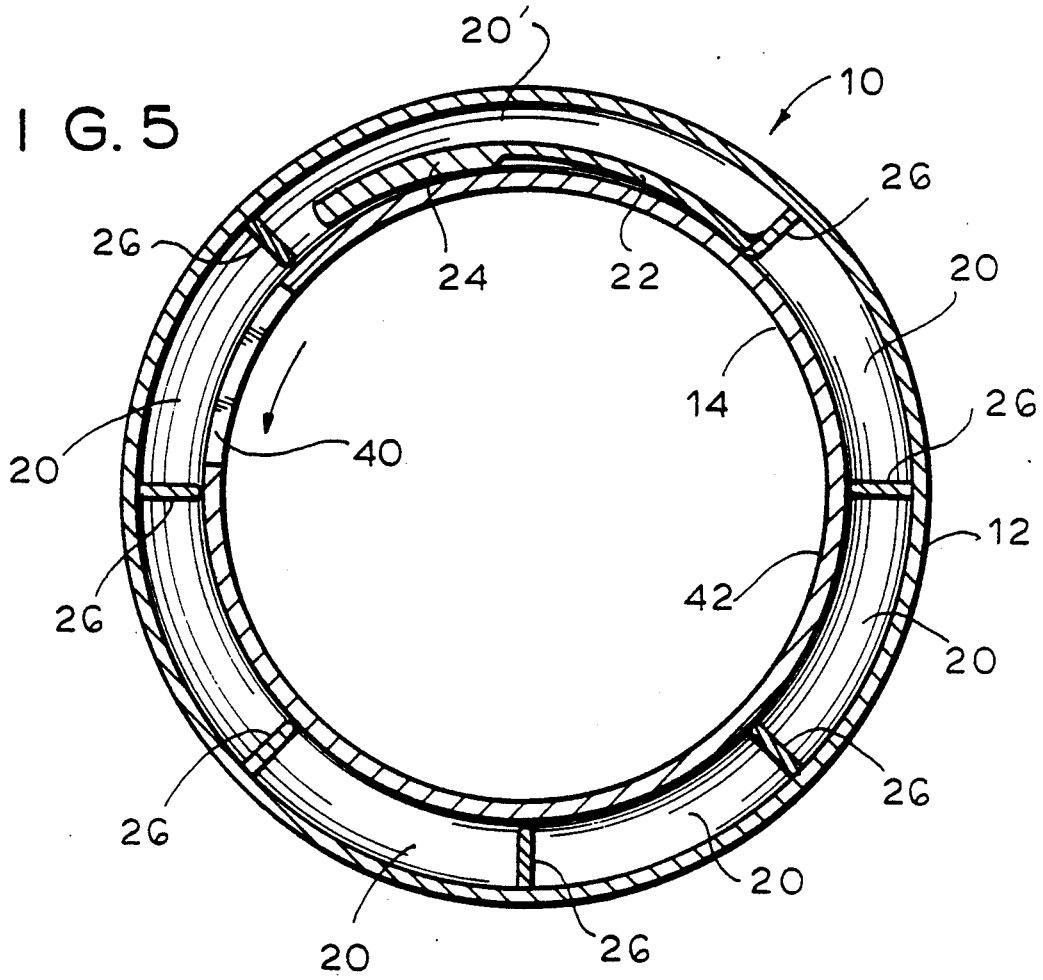
FIG. 5 is a view similar to FIG. 2, but with the inner and outer members in a different relative rotational orientation.

Referring now to the drawing, and in particular to FIGS. 1–3 thereof, therein illustrated is a ring, generally designated by the reference numeral 10, according to the present invention. The ring 10 is comprised of two circular members in concentric or coaxial disposition: an outer member 12 and an inner member 14. The ring 10 has the general appearance of a normal or ordinary ring without any hidden internal compartments, and in particular a wedding band.

The outer member 12 defines a plurality of at least three laterally spaced, inwardly open compartments 20 and an inwardly biased tab 22 at least partially disposed in a predetermined one 20' of the compartments 20. The compartments 20 are laterally separated by thin walls 26. Each of the six smaller compartments 20 illustrated is at least of sufficient size (ca. 5–6 mm in length) to hold a small diamond or like valuable article, and the radially inward surface thereof defines an opening 28 through which a precious stone or other small article can be passed radially into and out of the compartment 20. The predetermined one compartment 20' is about three times the length of the smaller compartments 20 (about 12–16 mm in length). The tab 22 is secured to the remainder of the outer member 12, and, more particularly, has one end portion disposed in the predetermined one compartment 20' (as shown, attached to a thin wall 26 thereof) and the other end portion 24 (as shown, the free end portion) movable between a first position totally within compartment 20' and a second position partially without compartment 20'. The free end portion 24 is biased inwardly—that is, out of the compartment 20' and towards the central axis of the ring 10. The inward bias of the tab 22 may be caused either by the resilient metal used to form the tab 22, as illustrated, or by a separate biasing member (not shown) disposed within the compartment 20' and bearing radially inwardly on the free end portion of tab 22. A suitable resilient material is "hard" or "spring" gold which also enables the one end portion of tab 22 to be soldered, with conventional gold solder, to the thin wall 26 of compartment 20'.

The outer member 12 is preferably U-shaped in cross section, the base and length of the U being defined by the outer member 12, and the space between the free ends of the legs of the U defining the inward opening 28.

The inner member 14 is coaxially or concentrically mounted on the outer member 12 for relative rotation thereto. A variety of constructions well known to those in the ring and mechanical arts may be used in order to concentrically or coaxially mount the outer and inner members 12, 14 together in such a way as to enable relative rotation thereof. The inner member 14 defines a single aperture 40 extending therethrough. The aperture 40 is preferably configured and dimensioned similar to (i.e., coextensive with) the inward openings 28 of the compartments 20. Thus, the aperture 40, depending on the relative rotational orientation of the outer and inner members 12, 14, receives at least partially therein the free end portion 24 of tab 22 or acts as a passageway into and out of the inward opening 28 of a radially aligned one of the compartments 20.

The inner member 14 includes a cylindrical body 42, including aperture 40, and a radially outwardly extending flange 44 on each side thereof. The flanges 44 extend to and overlap for an appreciable distance the sides of the outer member 12. Thus the outer member 12 sits at least partially within a U-shaped channel defined by the opposed surfaces of the flanges 44 and the outer surface of cylindrical body 42 therebetween.

To construct the ring 10, the cylindrical body 42 of inner member 14 is coaxially placed within the outer member 12, and the flanges 44 are then soldered to the sides of the cylindrical body 42 using conventional gold solder. Alternatively, one of the flanges 44 may be formed integrally with the cylindrical body 42, and, after insertion of the cylindrical body 42 within the outer member 12, the remaining flange 44 is soldered onto the exposed side of the cylindrical body 44 to complete the inner member 14.

The inner member 14 is easily rotated relative to the outer member 12 in the direction of arrow 50 because, during the course of relative rotation in the proper direction, the wall of aperture 40 underlying the tab 22 bears on the tab 22 and therefore cams the tab 22 outwardly, causing it to retreat into the predetermined one compartment 20'. On the other hand, rotation of the inner member 14 in the opposite direction relative to the outer member 12 is blocked by the abutment of the opposed wall of aperture 40 and the adjacent portion of the tab free end portion 24 lying within aperture 40. Thus tab 22 of outer member 12 and aperture 40 of inner member 14 together enable relative rotation of the two members 12, 14 in one direction, while blocking such relative rotation in the opposite direction.

The outer and inner members 12, 14 are preferably made of a metal, especially a metal such as gold which is conventionally used in wedding bands, so that there is nothing remarkable or unusual in the appearance of the ring. Because the only access to a compartment 20 is through the inward opening 28 and the aligned aperture 40, articles can not be inserted into or removed from the ring 10 while the ring is being worn. Indeed, while the ring is being worn, the presence of the hidden internal compartments 20 is not visible. Accordingly, the ring provides a high degree of security for the hidden articles, especially when the ring is being worn. Indeed, even if there is a suspicion that there are hidden internal compartments within the ring which are exposed by relative rotation of the inner and outer members, relative rotation of the members in the wrong direction will be blocked and thereby allay the suspicion, as only a relative rotation of the members in the correct direction will reveal the presence of the article-containing compartments.

To summarize, the present invention provides a ring having a plurality of hidden internal compartments which can not be accessed while the ring is being worn. The ring has the appearance of a normal ring, such as a wedding band, and is of a rugged and economical construction.

Now that the preferred embodiments of the present invention have been shown and described in detail, various modifications and improvements thereon will become readily apparent to those skilled in the art. Accordingly, the spirit and scope of the invention is to be broadly interpreted and limited only by the appended claims, and not by the foregoing disclosure.

I claim:

1. A ring with a plurality of hidden internal compartments for receiving articles, comprising:

(A) an outer circular member defining an inwardly biased tab and a plurality of laterally separated, inwardly open compartments for receiving articles, said inwardly biased tab being at least partially disposed in a predetermined one of said compartments; and (B) an inner circular member concentrically mounted on said outer member for rotation relative thereto and defining a single aperture therethrough, said aperture being configured and dimensioned to at least partially receive said tab or to act as a passageway for articles into and out of a radially aligned one of said compartments, depending upon the relative rotational orientation of said inner and outer members.

2. The ring of claim 1 wherein said inner and outer members together have the appearance of a normal ring without any hidden internal compartment.

3. The ring of claim 2 wherein said inner and outer members together have the appearance of a wedding band.

4. The ring of claim 1 wherein said tab has one end portion thereof secured in said predetermined one compartment and the other end portion thereof movable between a first position wherein said other end is disposed in said predetermined one compartment of said outer member and a second position wherein said other end extends into said aperture of said inner member, said other end of said tab permitting relative rotation of said inner and outer members in one direction while blocking relative rotation of said inner and outer members in the opposite direction.

5. The ring of claim 4 wherein said other end of said tab is biased for movement from said first position into said second position, said other end in said second position being displaceable into said first position by relative rotational orientation of said inner and outer members.

6. The ring of claim 1 wherein said outer circular member defines at least three of said compartments, and the relative rotational orientation of said inner and outer members determines the one of said compartments to be radially aligned with said aperture.

7. The ring of claim 1 wherein said aperture acts as a radial passageway into and out of said aligned one compartment.

8. The ring of claim 7 wherein said compartments are accessible only through said aperture.

9. The ring of claim 8 wherein said compartments are not accessible when said ring is being worn.

10. The ring of claim 1 wherein said inner and outer members are coaxially mounted for relative rotation within a given plane.

11. The ring of claim 1 wherein said aperture is coextensive with the inwardly open wall of said aligned one compartment.

12. A ring with a plurality of hidden internal compartment for receiving articles, comprising:

(A) an outer circular member defining a plurality of at least three laterally separated, inwardly open compartments for receiving articles and a inwardly biased tab at least partially disposed in a predetermined one of said compartments;

said tab having one end portion thereof secured in said predetermined one compartment and the other end portion thereof movable between a first position wherein said other end is disposed in said predetermined one compartment of said outer member and a second position wherein said other end extends into said aperture of said inner member, said other end of said tab permitting relative rotation of said inner and outer members in one direction while blocking relative rotation of said inner and outer members in the opposite direction, said other end of said tab being biased for movement from said first position into said second position and in said second position being displaceable into said first position by relative rotational orientation of said inner and outer members; and (B) an inner circular member concentrically mounted on said outer member for rotation relative thereto and defining a single aperture therethrough, said aperture being configured and dimensioned to at least partially receive said tab or to act as a passageway for articles into and out of a radially aligned one of said compartments, depending upon the relative rotational orientation o said inner and outer members, the relative rotational orientation of said inner and outer members determining the one of said compartments to be radially aligned with said aperture, said aperture acting as a radial passageway into and out of said aligned one compartment, said aperture being coextensive with the inwardly open wall of said aligned one compartment;

said inner and outer members being coaxially mounted for relative rotation within a given plane and together having the appearance of a normal ring without any hidden internal compartment, said compartments being accessible only through said aperture and not being accessible when said ring is being worn.

* * * * *